US005812111A

United States Patent [19]

Fuji et al.

[11] Patent Number: 5,812,111

[45] Date of Patent: Sep. 22, 1998

[54] BIFOCAL PICTURE DISPLAY SYSTEM

[75] Inventors: Hiroko Fuji; Shoichiro Nakai, both of Tokyo, Japan

[73] Assignee: NEC Corporation, Tokyo, Japan

[21] Appl. No.: 509,010

[22] Filed: Jul. 31, 1995

[30] Foreign Application Priority Data

Aug. 30, 1994 [JP] Japan ..... 6-204083

[51] Int. Cl.[6] ..... G09G 5/36

[52] U.S. Cl. ..... 345/131; 345/127

[58] Field of Search ..... 345/127, 131, 345/439; 395/139; 348/581; 364/449.6

[56] References Cited

U.S. PATENT DOCUMENTS 4,790,028 12/1988 Ramage ..... 345/127

FOREIGN PATENT DOCUMENTS

| | | |
|---|---|---|
| 57-19790 | 2/1982 | Japan . |
| 62-44008 | 2/1987 | Japan . |
| 63-98789 | 4/1988 | Japan . |
| 2-300924 | 12/1990 | Japan . |
| 4-258995 | 9/1992 | Japan . |
| 5-274441 | 10/1993 | Japan . |
| 6-161411 | 6/1994 | Japan . |

OTHER PUBLICATIONS

K. Misue et al., "A Method to Display the Whole and Details in One . . . for Graphic Interface", *5th Symposium on Human Interface of SICE*, Oct., 1989, pp. 463–468.

Y. K. Leung, "Human–Computer Interface Techniques for Map Based Diagrams", *Designing and Using Human–Computer Interfaces and Knowledge Based Systems*, 1989, pp. 361–368.

H. Fuji et al., "Real–time bifocal network visualization", *The Institute of Electronics, Information and Communication Engineers*, Technical Report of IEICE, IN93–101, 1993, pp. 31–36.

T. Okazaki et al., "Multi–Fisheye Distortion Method of The Network Map", *The Institute of Electronics, Information and Communication Engineers*, Technical Report of IEICE, IN94–116, 1994, pp. 59–66.

*Primary Examiner*—Jeffery Brier

*Attorney, Agent, or Firm*—Sughrue, Mion, Zinn, Macpeak & Seas, PLLC

[57] ABSTRACT

In a Bifocal display which is composed of magnified and de-magnified sections of an original picture. The Bifocal display displays a focused section which is magnified for detailed information with the remaining sections of the original picture for outline recognition at the same time in a figure, means for selecting a desired detailed image among several specialized detailed images, means for selecting suitable magnification coefficient for the focused section, means for superimposing another semi-transparent image on a displaying Bifocal figure, or means for modifying displaying colors in an instance are materialized to offer a better human-computer interface for a network monitoring display, for example.

14 Claims, 15 Drawing Sheets

FIG.17 PRIOR ART
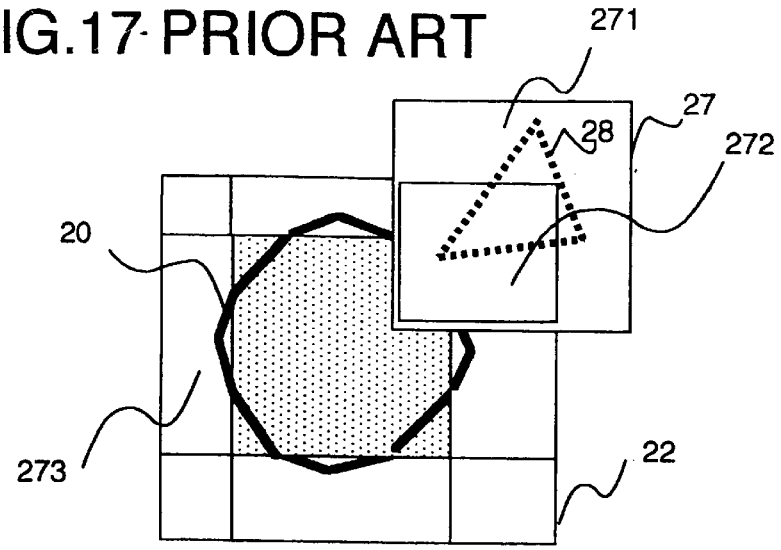
FIG.18
TRANSPARENCY COEFFICIENTS ($0<\alpha<1$)
| SECTION | BIFOCAL SIGNALS | SUPERIMPOSED SIGNALS |
|---|---|---|
| 271 | 0 | 1 |
| 272 | $\alpha$ | $1-\alpha$ |
| 273 | 1 | 0 |
FIG.19
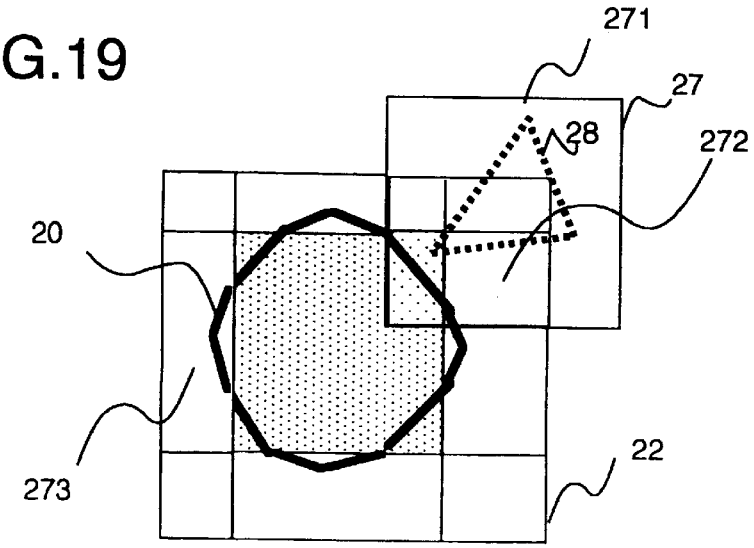

BIFOCAL PICTURE DISPLAY SYSTEM

BACKGROUND OF THE INVENTION

The present invention relates to a picture image display in a computer system having such a display device as a CRT for displaying such a picture image as a network chart or a map.

When a computer system is displaying a picture image stored in a memory on a display screen, there are cases where a magnified image of an area of the picture is displayed for detailed information on the same screen.

Many research projects have been reported concerning the techniques for displaying a partial detailed image of a picture as a map.

In "A method to display the whole and details in one figure" by Misue et al on pp. 463–468 of the collected papers of the 5th Symposium on Human Interface of SICE (the Society of Instruments and Control Engineers), techniques named "M coordinate systems" are proposed for eliminating demerits of multi-window techniques by which a window for displaying detailed information overlaps another window displaying the outline image of the whole picture and hides the overlapped section of the outline image.

In "Human-Computer Interface Techniques for Map Based Diagrams" by Y. K. Leung et al on pp. 364–367 of "Designing and Using Human-Computer Interfaces and Knowledge Based Systems" published in 1989, the technique named "Bifocal display system" is reported as an effective technique for displaying a detailed image and the whole outline image at the same time. This "Bifocal display system" has the same concept as the "M3 coordinate system" of the above mentioned "M coordinate systems", and hereafter the "Bifocal display system" and the "M3 coordinate system" are called Bifocal system and a figure displayed by the Bifocal system is called a Bifocal figure.

In the Bifocal system, as shown in FIG. 9, when a section 215 of an original picture 21 with display information 20 is displayed in a magnified scale, the original picture 21 is divided into nine sections from sections 211 to 219, eight of which surround the section 215.

Each of the divided sections is processed for magnification or de-magnification using predetermined coefficients. That is, the section 215 is magnified by a predetermined magnification coefficient p (p>1) in both x and y directions, the section 214 and 216 are de-magnified by a predetermined de-magnification coefficient 1/q (q>1) in the x direction and magnified by p in the y direction, the sections 212 and 218 are magnified by p in x direction and de-magnified by 1/q in the y direction, while the sections 211, 213, 217 and 219 are de-magnified by 1/q in both the x and y directions.

After these magnifications or de-magnifications, all these sections are assembled to form a picture as shown in FIG. 10.

In this way, in the Bifocal system, a new picture composed of a magnified picture of a focused section of an original picture and pictures of all the remaining sections whose lengths and widths are each magnified or de-magnified according to the magnification coefficient p is displayed without a loss of information in the dimensions of the original picture. The new picture has the advantage that a user can search detailed information of a local section while always grasping the outline of the whole picture on a screen.

As a prior art for materializing this Bifocal system, there is a Japanese patent application laid open as a preliminary patent publication No. 274441/'93.

The picture image display disclosed in this patent application comprises memories for storing bit map data of pictures, whose predefined sections have been previously magnified or de-magnified in the above described 4 ways from an original picture for generating a Bifocal figure.

FIG. 2 shows a block diagram of the prior art.

An xy magnified bit map memory 101 stores xy magnified bit map data obtained from an original picture by magnifying by p in both x and y directions predefined sections of the original picture, while an x magnified bit map memory 102 stores x magnified bit map data obtained by magnifying by p in the x direction and de-magnifying by 1/q in the y direction predefined sections of the original picture. Similarly, a y magnified bit map memory 103 stores y magnified bit map data obtained by de-magnifying by 1/q in x direction and magnifying by p in y direction each predefined section of the original picture and an xy de-magnified bit map memory 104 stores xy de-magnified bit map data obtained by de-magnifying by 1/q in both x and y directions predefined sections of the original picture.

A display picture generating unit 105 calculates boundary addresses of rectangular sections of the original picture which are stored in these memories to be read. When a Bifocal figure 22, as shown in FIG. 10, is to be displayed, the display picture generating unit 105 calculates boundary addresses of a rectangular section of the original picture which is stored in the xy magnified bit map memory 101 which corresponds to section 215 of the Bifocal figure 22, boundary addresses of rectangular sections of the original picture which is stored in the x magnified bit map memory 102 which corresponds to sections 212 and 218, boundary addresses of the original picture which is stored in the sections of y magnified bit map memory 103 which corresponds to sections 214 and 216, and boundary addresses of rectangular sections of the original picture which is stored in the xy de-magnified bit map memory 104 which corresponds to sections 211, 213, 217 and 219.

A display data reading unit 106 for reading out bit map data reads out bit map data from the memories 101–104 according to the boundary addresses calculated by the display picture generating unit 105 as described above and generates display signals.

Since the bit map data necessary for generating the Bifocal figure are previously stored in the memories, the picture image display of the prior art can compose and display a desired Bifocal picture at high speed by changing the boundary addresses of the sections of memories to be read.

In "Real-time bifocal network visualization" by Fuji et al on pp. 31–36 of IN93-101 of the Technical Report of IEICE (the Institute of Electronics, Information and Communication Engineers), the Bifocal system is applied for a network monitoring system. This network monitoring system has a Bifocal system display wherein bit map data of a network chart magnified or de-magnified in the above mentioned 4 ways are stored in memories 101 to 104 in FIG. 2 respectively and by a mouse click of a point in a displayed figure, a Bifocal figure magnifying the section around the clicked point is displayed in real time.

As described above, the Bifocal system is proposed as an effective technique for displaying detailed local information with the whole outline information of a picture in one figure, materialized in a hardware for high speed processing, as disclosed in the preliminary patent publication No. 274441/'93, and an application of the Bifocal system to a network monitoring system is also proposed in aforementioned "Real time bifocal network visualization". In the network monitoring system, detailed information including the names of nodes in the network composition are displayed on an enlarged area together with the total network chart so that the total network can always be monitored on a screen.

However, there are cases where various kinds of information such as traffics in the network or history of past troubles in the network, for example, are desired to be displayed effectively on a monitoring display according to the demands for grasping the operating state of the network.

However, it is difficult to display all the necessary information simultaneously. In addition, when displayed information is complex, the user will be embarrassed. Therefore, selection of necessary information according to circumstances is desired.

These prior art Bifocal systems can not meet the above-mentioned demands, because they have only a single set of xy magnified bit map data and can not change picture being displayed by selecting a picture wherein information related to a particular circumstance is included.

And as seen in most of communication networks in Japan which have a dual node concentrated center of Tokyo and Osaka, distributions of communication nodes are not uniform. Therefore, different magnification coefficients are desired for the node concentrated areas as opposed to other areas.

The prior art Bifocal systems can not meet the above-mentioned demands because of the use of a fixed magnification coefficient.

SUMMARY OF THE INVENTION

Therefore, an important object of the present invention is to provide a Bifocal system display comprising plural memories for storing plural set of xy magnified bit map data whereof a desired set of xy magnified bit map data is selected for changing picture information to be displayed according to circumstances.

Another object of the invention is to provide a Bifocal system display comprising a plural set of memories for storing bit map data, each set of memories for storing bit map data comprising plural memories for storing plural sets of xy magnified bit map data, a memory for storing x magnified bit map data, a memory for storing y magnified bit map data and a memory for storing xy de-magnified bit map data for displaying Bifocal figures having different magnification coefficients.

Still another object of the invention is to provide a Bifocal system display adapted to be used in a network monitoring system, wherein detailed information is displayed on a magnified section and the detailed information can be changed by selecting a set of xy magnified bit map data corresponding to an operating state of the network or a monitoring purpose among a plural set of xy bit map data previously prepared for different detailed information to be displayed according to deferent monitoring purposes.

In preparing bit map data for a Bifocal system display of a network, there are problems. When symbols of nodes in a network chart are magnified or de-magnified by same coefficient with the network chart, the displayed dimensions of the symbols become different with respect to the magnified section and other sections, injuring coherence of display. Furthermore, when as same amount of information is displayed on de-magnified sections as on a magnified section, recognition of the information may become difficult since the information on the de-magnified sections becomes too dense.

Still another object of the invention is to solve these problems. Bit map data for displaying Bifocal figures of a network of the present invention are prepared in consideration of shapes of the symbols and the amount of information to be displayed.

There are various kinds of information to be displayed on a network monitoring screen, and it is important that a user can easily detect any sign of problems and recognize the parts influenced by a particular problem on the screen. In the network monitoring system, objects which have reported any sign of a problem are displayed as blinking objects, the blinking of a particular object representing a change of status. This change of displayed color can easily attract the attention of the operator. But it will take a lot of time when the displayed picture is re-drawn for changing color and quick information can not be offered.

Still another object of the invention is to provide means for a quick change of displayed colors.

In a monitoring system of a network, it is often necessary to display a picture representing such information as individualized information associated with communication equipment of the network or detailed information concerning a problem together with the whole chart of the network. As Bifocal systems of the prior art are systems for displaying only one magnified section, those systems can not meet the above described demands of user. Nor can the prior art systems display a plural number of magnified sections on a screen. Using another window, another picture can be displayed on the same screen but there may be an overlapped area on the screen and a problem that the information in the overlapped area is lacked.

Still another object of the present invention is to solve the problem and to display the two pictures discernible without a lack of information in case when some areas are overlapped.

BRIEF DESCRIPTION OF THE DRAWINGS

The foregoing and other objects, aspects and advantages of the present invention will become apparent from the following detailed description of the invention with reference to the drawings, in which:

FIG. 17 shows a display image of a Bifocal figure and another picture of a prior art.

FIG. 18 shows a semi-transparent coefficient table.

FIG. 19 shows a semi-transparent superimposed picture on a Bifocal figure.

DETAILED DESCRIPTION OF THE PREFERRED EMBODIMENTS

The present invention will be described in connection with the drawings.

Figure 1:
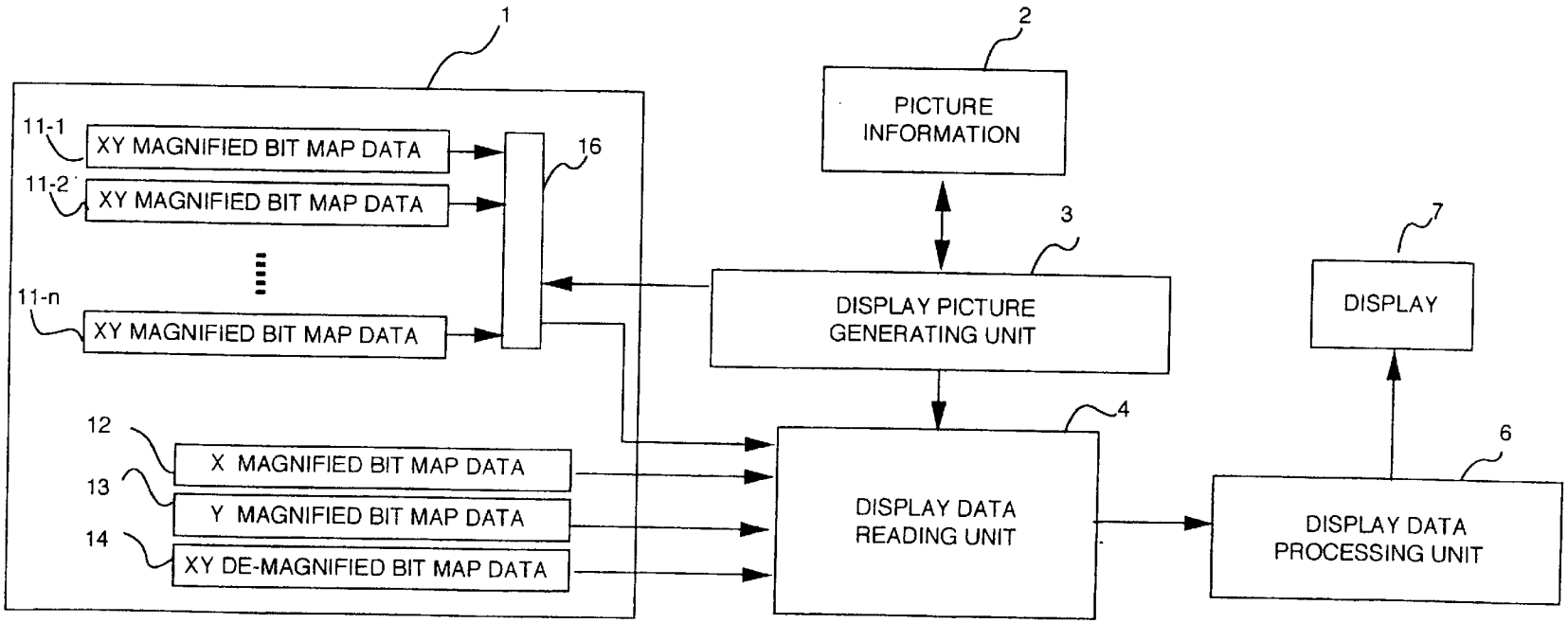
FIG. 1 is a block diagram of a first embodiment of the present invention.
Figure 2:
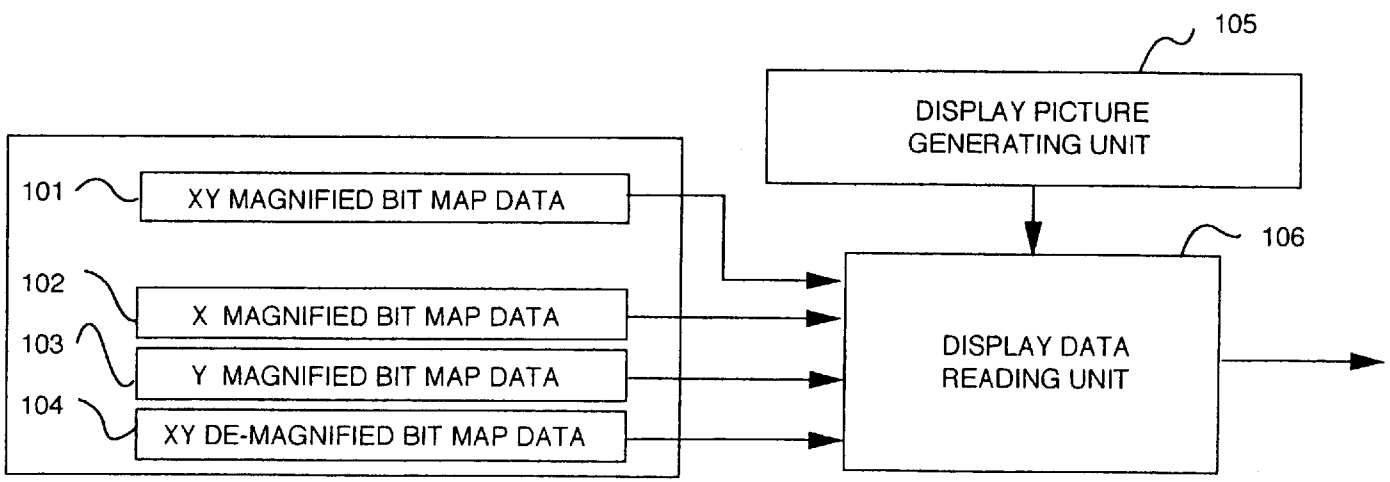
FIG.2 PRIOR ART
FIG. 2 is a block diagram of a prior art.

FIG. 1 shows a block diagram of a first embodiment of this invention.

Figure 9:
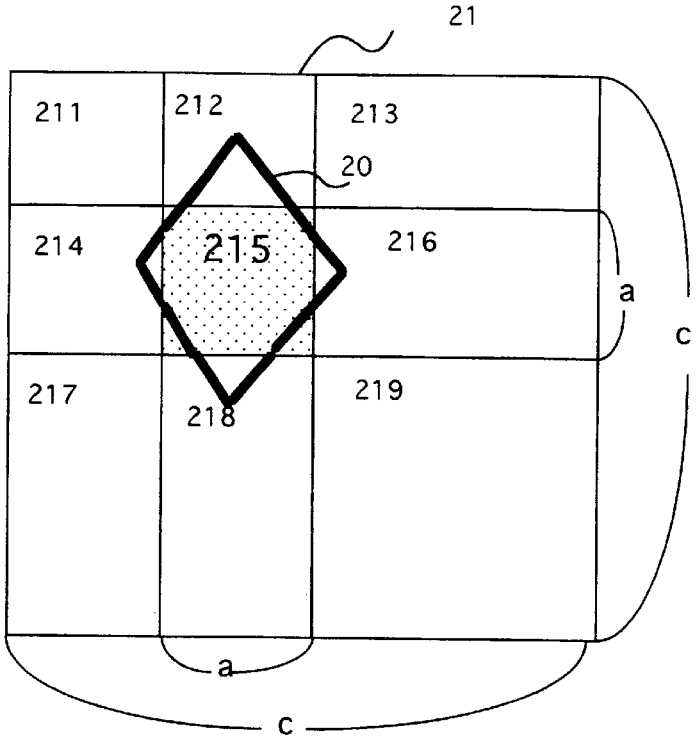
FIG. 9 shows an original picture.
Figure 10:
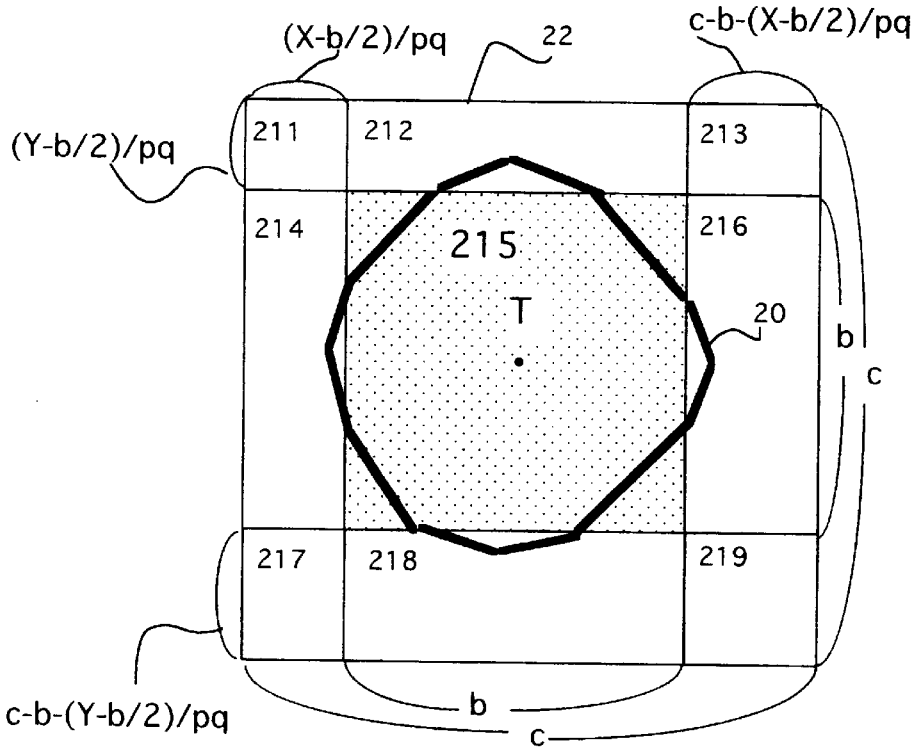
FIG. 10 shows a Bifocal figure corresponding to the original picture 21 in FIG. 9.

In this embodiment, an original picture 21 with a display object 20 shown in FIG. 9 is displayed as shown in FIG. 10, wherein the whole of the display object 20 is displayed in a Bifocal figure 22 without a break or a loss and the display object 20 in focused section 215 is magnified by p in both x and y directions.

The original picture 21 of FIG. 9 is divided into nine rectangular sections, that is, sections 211–219 including the focused section 215. The Bifocal figure 22 of FIG. 10 is composed of a picture of section 215 of the original picture 21 which is magnified by p in both x and y directions, pictures of sections 212 and 218 which are magnified by p in the x direction and de-magnified by 1/q in the y direction, pictures of sections 214 and 216 which are de-magnified by 1/q in the x direction and magnified by p in the y direction, and pictures of sections 211, 213, 217 and 219 which are de-magnified by 1/q in both x and y directions.

In order to generate this type of picture, xy magnified bit map data obtained from the original picture 21 by magnifying predefined sections of the original picture by p in both x and y directions, x magnified bit map data are obtained from the original picture 21 by magnifying predetermined sections of the original picture by p in the x direction and de-magnifying predefined sections of the original picture by 1/q in the y direction, y magnified bit map data are obtained from the original picture 21 by de-magnifying predefined sections of the original picture by 1/q in x direction and magnifying predefined sections of the original picture by p in the y direction and xy de-magnified bit map data are obtained from the original picture 21 by de-magnifying predefined sections of the original picture by 1/q in both the x and y directions. The above-mentioned bit map data are previously prepared and data for displaying each rectangular section are selected and read out from each corresponding bit map data for composing the Bifocal figure 22 of FIG. 10.

It is noted here, that a, b, c in FIG. 9 and FIG. 10 are related as following equations.

$$b=pa,\ c=b+(c-a)/q \tag{1}$$

When this Bifocal system is employed for displaying a map, detailed information may be supplemented in xy magnified bit map data, since contents of xy magnified bit map data are displayed on the magnified section 215 of the Bifocal figure 22. Thus the Bifocal system can supply detailed map information.

In this embodiment, there are various kinds of xy magnified bit map data having a same magnification ratio (p in both x and y directions) but with different supplemental information. Each set of these xy magnified bit map data is stored in one of xy magnified bit map memories 11-1, 11-2, . . . 11-n in picture data storing means 1 and a selector 16 is provided for selecting any one of the xy magnified bit map memories 11-1, 11-2, . . . 11-n in the picture data storing means 1.

The picture data storing means 1 further comprises an x magnified bit map memory 12 for storing the x magnified bit map data, a y magnified bit map memory 13 for storing the y magnified bit map data and an xy de-magnified bit map memory 14 for storing the xy de-magnified bit map data. Each bit map memory has a bit depth required for storing each corresponding bit map data.

A picture information storing unit 2 stores information of each bit map data stored in each bit map memory including the address information of each bit map memory.

A display picture generating unit 3 receives a command for generating the Bifocal figure 22 wherein a kind of detailed information to be displayed and a section to be magnified are specified. The display picture generating unit 3 controls the selector 16 and selects an xy magnified bit map memory, for example, the xy magnified bit map memory 11-1 referring to the information stored in the picture information storing unit 2 in accordance with the requested detailed information, and calculates boundary addresses of sections to be read, that is, section 215 of the xy magnified bit map memory 11-1, sections 212 and 218 of the x magnified bit map memory 12, sections 214 and 216 of the y magnified bit map memory 13 and sections 211, 213, 217 and 219 of the xy de-magnified bit map memory 14, by referring to the address information stored in the picture information storing unit 2.

Now, data storage and calculation associated with the boundary addresses of this embodiment are described in connection with FIGS. 11–14.

Figure 11:
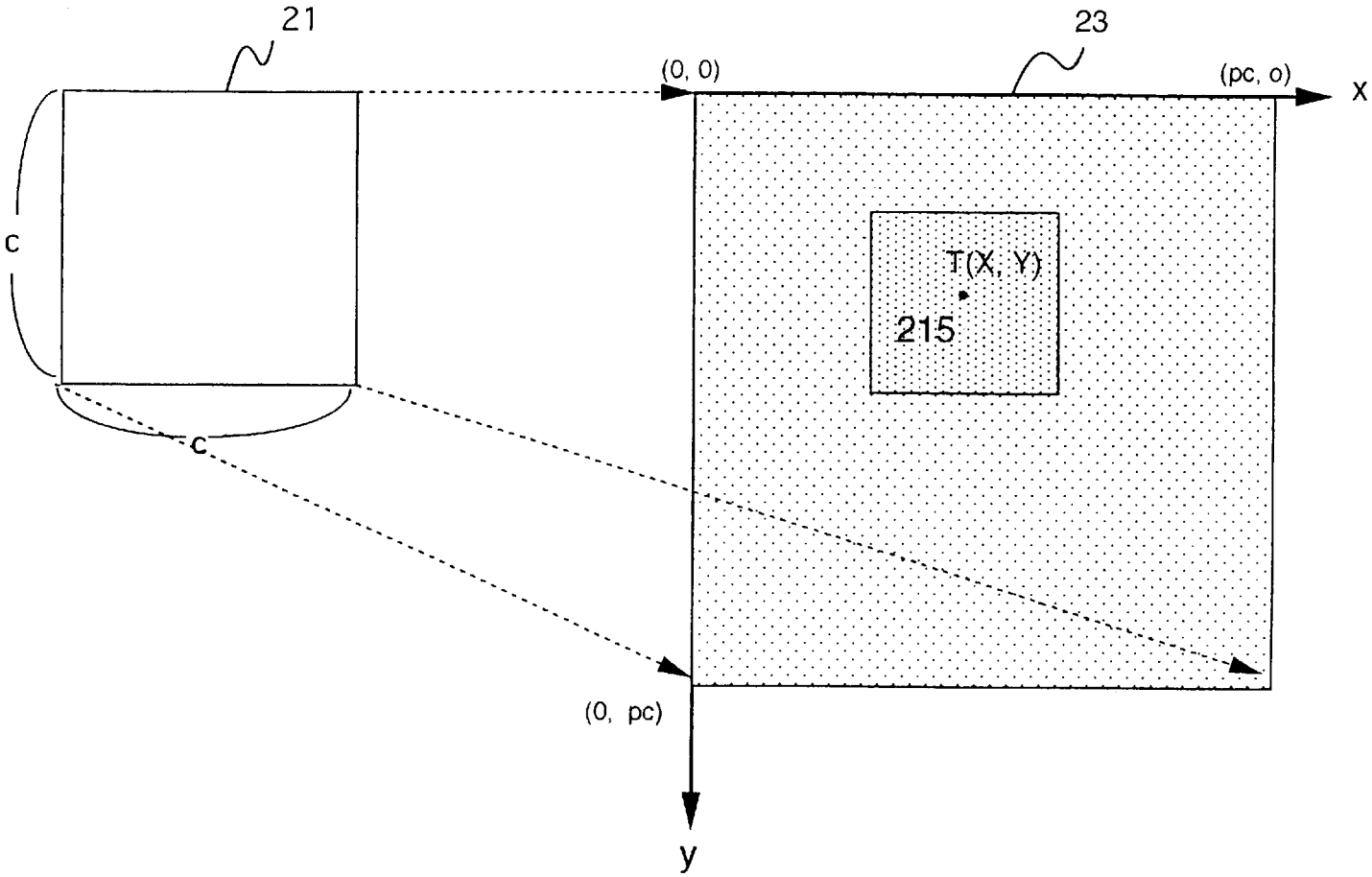
FIG. 11 shows a scheme for storing xy magnified bit map data.

In FIG. 11, the bit map data of the original picture 21 is magnified by p in both x and y directions to compose xy magnified bit map data 23. Thus, when the bit map data of the original picture 21 are stored in a memory range of c×c, the bit map data in the xy magnified bit map memories 11-1, 11-2 . . . 11-n are stored in a memory range of pc×pc.

Figure 12:
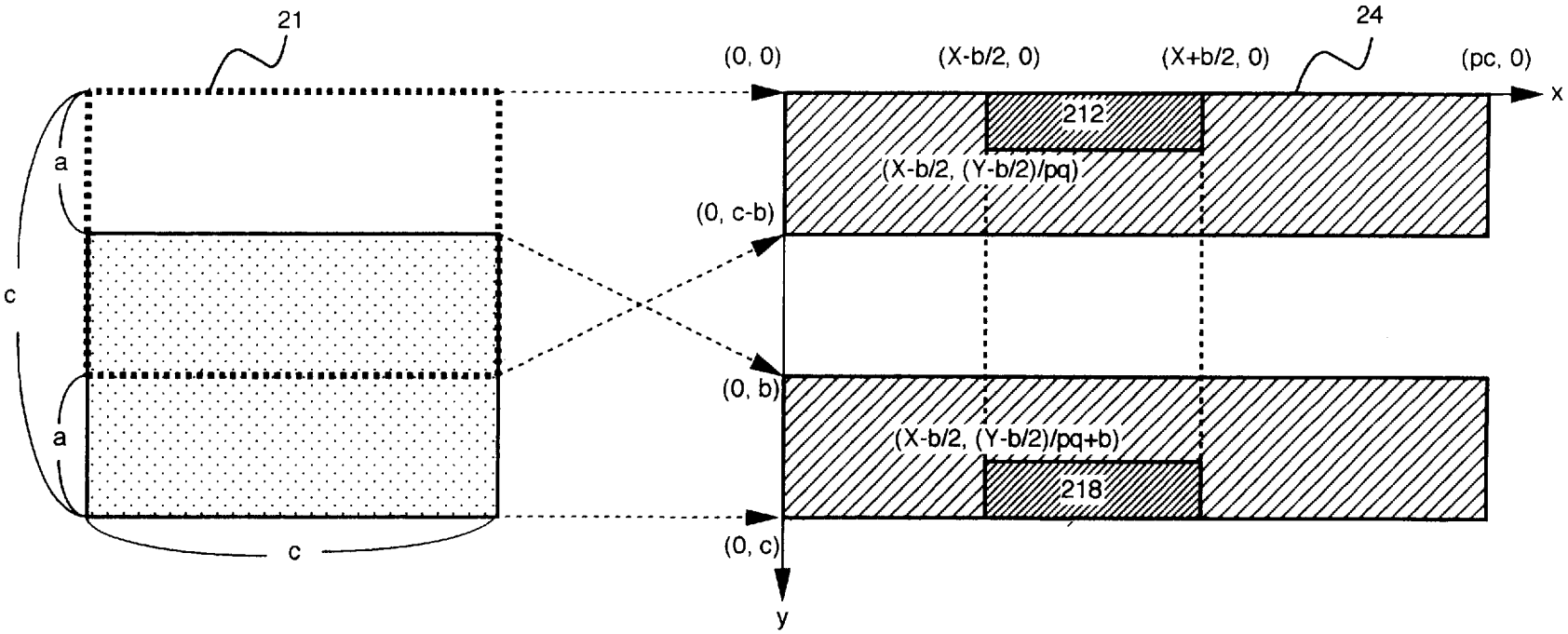
FIG. 12 shows a scheme for storing x magnified bit map data.

In FIG. 12, the bit map data of the original picture 21 is magnified by p in the x direction and de-magnified by 1/q in the y direction to compose an x magnified bit map data 24. In FIG. 12, an upper area from y=0 to y=c−a of the original picture 21 is magnified by p in the x direction and de-magnified by 1/q in the y direction to form an upper portion from y=0 to y=(c−a)/q of the x magnified bit map data 24, and a lower area from y=a to y=c of the original picture 21 is magnified by p in the x direction and de-magnified by 1/q in the y direction to form a lower portion from y=c−(c−a)/q to y=c of the x magnified bit map data 24. From equations (1), y=(c−a)/q means y=c−b and y=c−(c−a)/q means y=b as shown in FIG. 12.

The boundaries of the section 212 are x=X−b/2, x=X+b/2, y=0, y=(Y−b/2)/pq, and the boundaries of the section 218 are x=X−b/2, x=X+b/2, y=(Y−b/2)/pq+b, y=c, where (X, Y) represents coordinates of a center position T of the magnified section 215 shown in FIG. 11.

Figure 13:
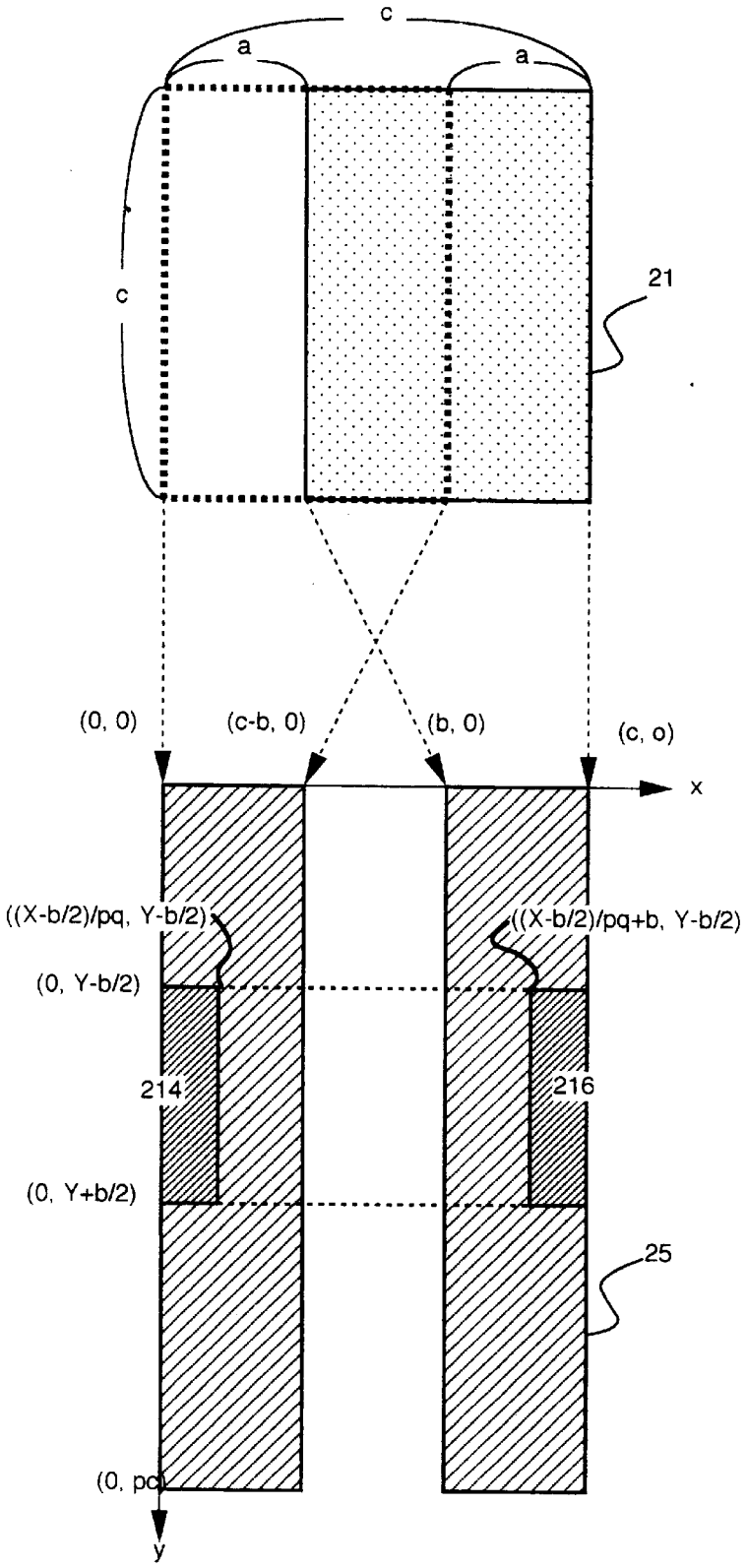
FIG. 13 shows a scheme for storing y magnified bit map data.

Similarly, y magnified bit map data 25 are formed as shown in FIG. 13, and the boundaries of the section 214 are x=0, x=(X−b/2)/pq, y=Y−b/2, y=Y+b/2, and the boundaries of the section 216 are x=(X−b/2)/pq+b, x=c, y=Y−b/2, y=Y+b/2.

Figure 14:
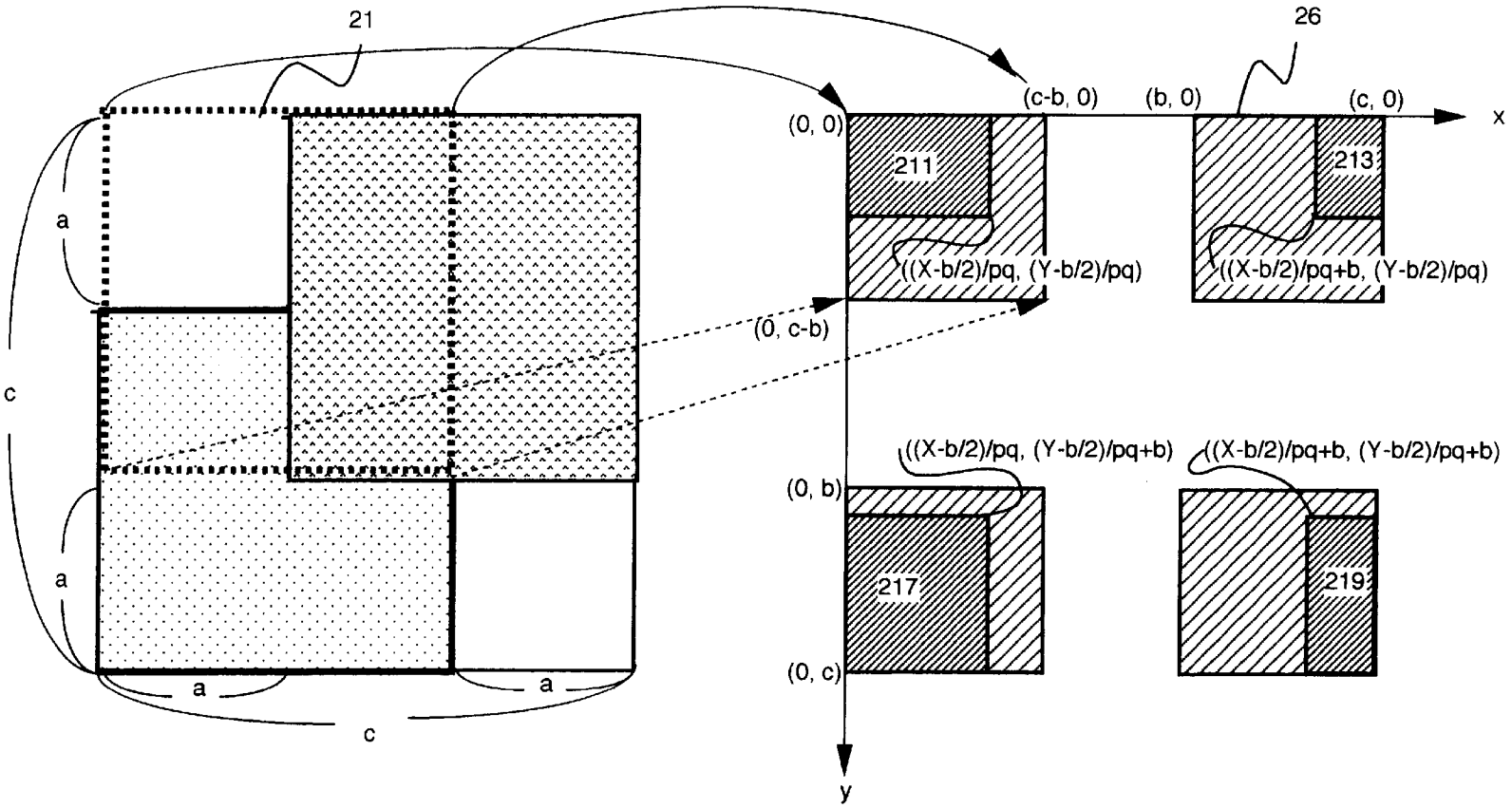
FIG. 14 shows a scheme for storing xy de-magnified bit map data.

In FIG. 14, bit map data of the original picture 21 is de-magnified by 1/q in both the x and y directions to compose a de-magnified bit map data 26. A rectangular area of (0, 0), (c−a, c−a) in the original picture 21 is de-magnified to form a rectangular area (0, 0), (c−b, c−b) in the de-magnified bit map data 26, a rectangular area of (a, a), (c, c) in the original picture 21 is de-magnified to form a rectangular area (b, b), (c, c) in the de-magnified bit map data 26. Similarly a rectangular area of (b, 0), (c, c−b), and a rectangular area of (0, b), (c−b, c) are formed in the de-magnified bit map data 26, the boundaries of the sections 211, 213, 217, 219 being represented as shown in FIG. 14, in relation to the center point T(X, Y) of the magnified area.

A display data reading unit 4 reads these bit map memories as scrolled according to the boundary addresses calculated by the display picture generating unit 3 for generating the Bifocal figure 22.

When the center of the xy magnified section, which is at the position T(X, Y) of the Bifocal figure 22 is changed, the values X, Y in the picture information storing unit 2 is changed, and the nine sections 211–219 are automatically displaced in the Bifocal figure 22, as the boundaries of these sections are functions of X, Y as shown in FIGS. 11–14.

A display data processing unit 6 converts each bit map data read out by the bit map data reading unit 4 to corresponding color signals to be displayed on a display unit 7, for forming the Bifocal figure 22.

Thus, in the first embodiment of this invention, change of detailed information displayed in the magnified area can be made by the selector 16, and displacement of the magnified area can be achieved by changing position data (X, Y) in the picture information storing unit 2, enabling a high speed processing.

Figure 3:
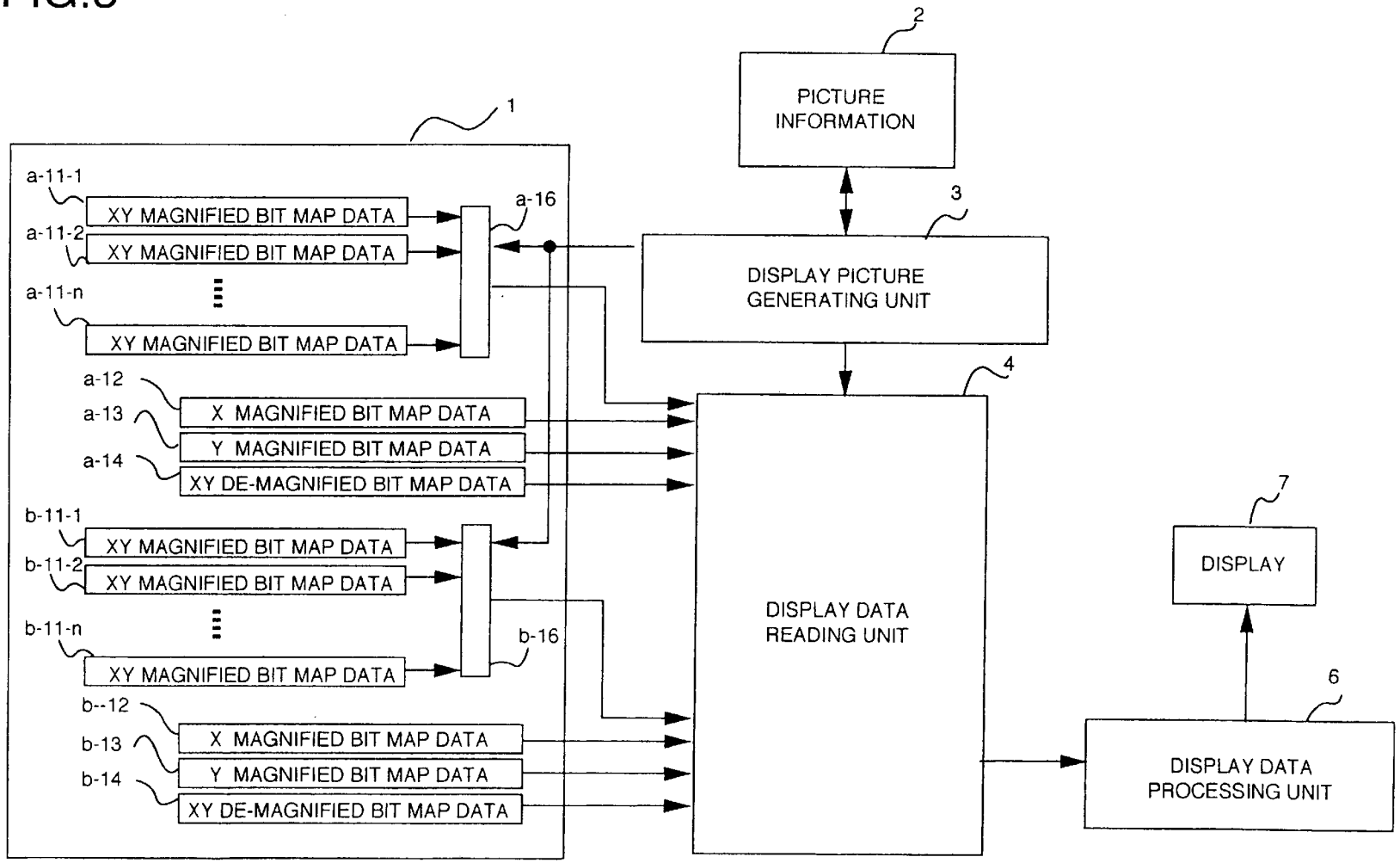
FIG. 3 is a block diagram of a second embodiment of the present invention.

FIG. 3 shows a second embodiment of this invention.

The picture data storing means 1 of FIG. 3 has plural (two in the embodiment shown in FIG. 3) sets of bit map memories. A first set of bit map memories has a magnification ratio of $p_1$ and a de-magnification ratio of $1/q_1$, and a second set of bit map memories has a magnification ratio of $p_2$ and a de-magnification ratio of $1/q_2$.

Xy magnified bit map memories a-11-1, a-11-2, . . . a-11-n, an x magnified bit map memory a-12, a y magnified bit map memory a-13 and an xy de-magnified bit map memory a-14 belong to the first set, together with a selector a-16. And an xy magnified bit map memories b-11-1, b-11-2, . . . b-11-n, an x magnified bit map memory b-12, a y magnified bit map memory b-13 and an xy de-magnified bit map memory b-14 belong to the second set, together with a selector b-16.

A picture information storing unit 2 stores information of each bit map data stored in each bit map memory including the address information of each bit map memory and also information of magnification coefficients as a function of coordinates in the original picture of areas to be magnified.

A display picture generating unit 3 receives a command for generating a Bifocal figure 22 wherein a kind of detailed information to be displayed and a section to be magnified are specified. Then the display picture generating unit 3 determines a set of the plural sets of bit map memories corresponding to the specified section to be magnified referring to the information stored in the picture information storing unit 2.

When, for example, the first set of bit map memories is to be displayed, and a detailed information stored in the xy magnified bit map memory a-11-1 is to be displayed, the display picture generating unit 3 selects the xy magnified bit map memory a-11-1 through the selector a-16 and calculates boundary addresses of sections to be read of the xy magnified bit map memory a-11-1, the x magnified bit map memory a-12, the y magnified bit map memory a-13, and the xy de-magnified bit map memory a-14, referring to the information stored in the picture information storing unit 2.

When the second set of bit map memories is to be displayed, and a detailed information stored in the xy magnified bit map memory b-11-2 is to be displayed, the display picture generating unit 3 selects the xy magnified bit map memory b-11-2 through the selector b-16 and calculates boundary addresses of the sections to be read of the xy magnified bit map memory b-11-2, the x magnified bit map memory b-12, the y magnified bit map memory b-13, and the xy de-magnified bit map memory b-14, referring to the information stored in the picture information storing unit 2.

The bit map memory reading unit 4 reads out these bit map memories as scrolled according to the boundary addresses calculated by the display picture generating unit 3 for generating the Bifocal figure 22 with a magnification coefficient convenient for the specified xy magnified section.

The display data processing unit 6 converts each bit map data read out by the bit map data reading unit 4 to corresponding color signals to be displayed by the display unit 7.

In this way, the Bifocal figure 22 has different magnification ratio in accordance with the magnified focused section in the second embodiment.

Figure 4:
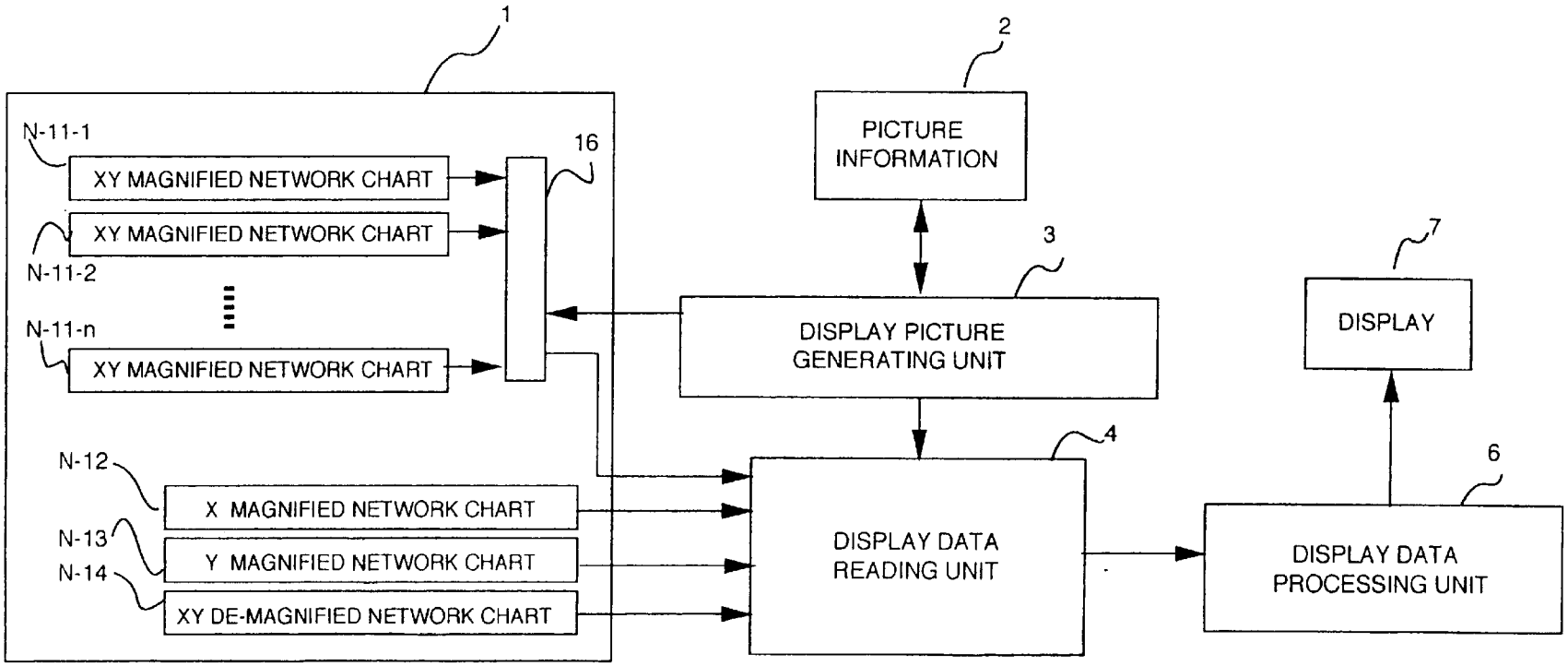
FIG. 4 is a block diagram of a third embodiment of the present invention.

FIG. 4 shows a block diagram of a third embodiment of this invention, wherein this invention is employed for displaying network charts.

As there is a wide variety of information to be displayed to a network supervisor for reporting an organization or an operating condition of equipment and nodes under supervision constituting a monitoring network, it is difficult to display all the necessary information on a single network chart.

Therefore, a Bifocal figure as shown in FIG. 10 is employed wherein change of operating conditions of all the equipment under supervision is always displayed on the screen, while detailed information in a section is displayed in a magnified scale on the screen. And since detailed information displayed in a magnified scale must be selected in accordance with a purpose of supervision, the first embodiment of this invention shown in FIG. 1 is conveniently employed for the network supervision.

In FIG. 4, an alphabet N prefixed to a numeral indicating a memory denotes that the memory contains a network chart data. For example, N-11-1 is an xy magnified network chart memory containing network chart data of all the connections between nodes in the chart, and N-11-2 is another xy magnified network chart memory containing network chart data of all the physical circuits between nodes.

As the block diagram of FIG. 4 is similar to that of FIG. 1 and the performance of the circuit of FIG. 4 is similar to that of FIG. 1, duplicated descriptions are avoided. For an example, when all the connections between nodes are required to be displayed in the enlarged area, the display picture generating unit 3 refers to information stored in the picture information storing unit 2, and controls the selector 16 for connecting the xy magnified network chart memory N-11-1.

Suppose, for example, all the physical circuits between nodes are newly required to be displayed on the screen when the Bifocal figure 22 is displayed by reading out the xy magnified network chart memory N-11-1, the display picture generating unit 3 refers to information stored in the picture information storing unit 2, and changes over the selector 16 to connect the xy magnified network chart memory N-11-2.

In preparing these magnified and de-magnified network chart memories N-11-1, N-11-2, . . . N-11-n, N-12, N-13 and N-14, from the original picture 21, if symbols of nodes and circuits are magnified or de-magnified by a same ratio determined as p and 1/q, the size and form of a symbol read out from one of the xy magnified network chart memories N-11-1, N-11-2, . . . N-11-n, the x magnified network chart memory N-12, the y magnified network chart memory N-13 and the xy de-magnified network chart memory N-14 become different from each other. This difference of size and form of symbols injures coherence of display.

In a fourth embodiment of this invention, same kinds of symbols are written in a same form and size in all the network chart memories in a picture data storing means 1 for maintaining coherence of displayed symbols.

When a lot of information is contained in the original picture 21, the information becomes indiscernible when displayed in a section de-magnified in either (or both) direction(s).

In a fifth embodiment of this invention, some information in the original picture 21 is omitted in the x magnified network chart memory N-12, the y magnified network chart memory N-13, and the xy de-magnified network chart memory N-14. Thus, for example, detailed information of nodes with names of the nodes and connections of nodes are stored in xy magnified network chart memories N-11-1, N-11-2, . . . N-11-n, while only symbols of nodes and a part of links as backbone lines spanned between important nodes are stored in the x magnified network chart memory N-12, the y magnified network chart memory N-13, and the xy de-magnified network memory N-14.

Here, embodiments wherein the first embodiment shown in FIG. 1 is applied in a network monitoring system have been described. It goes without saying that the second embodiment shown in FIG. 3 is also applicable to the network monitoring system, wherein the network monitoring system can display a Bifocal figure with magnification coefficient most convenient for the focused area, as with larger magnification coefficient for node concentrated areas than for other areas.

Figure 5:
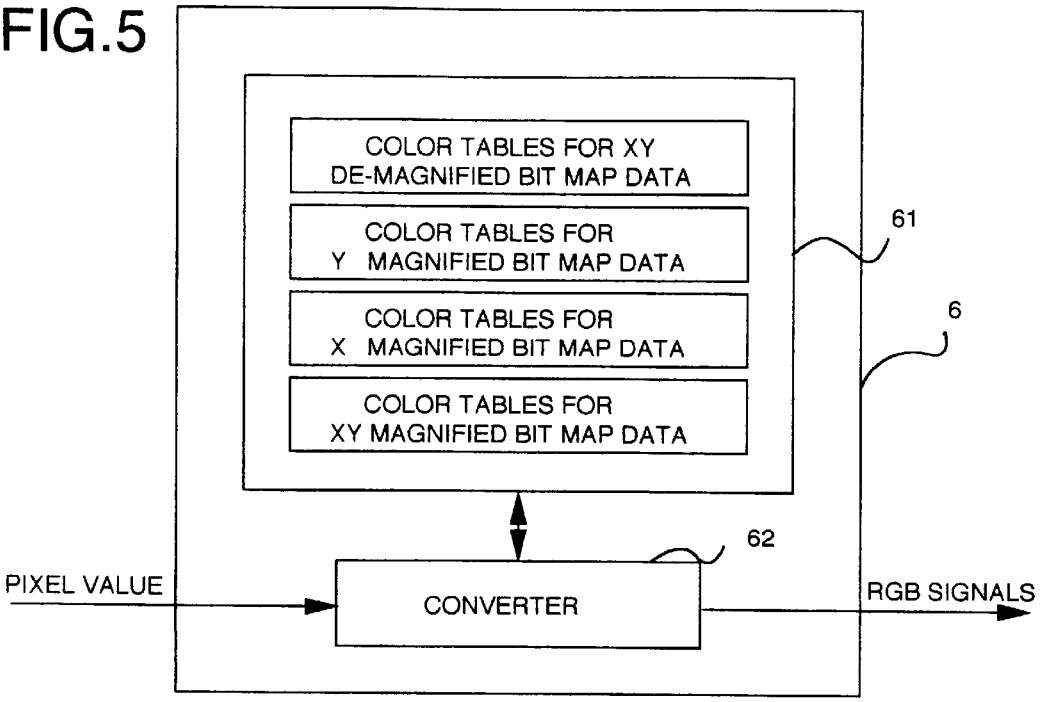
FIG. 5 shows an embodiment of display data processing unit 6 in FIG. 1 or FIG. 3.

FIG. 5 shows an embodiment of the display data processing unit 6.

In the embodiment shown in FIG. 5, the display data processing unit 6 has a color table memory 61 and a converter 62. The color table memory 61 has color tables to be used, for example, for xy magnified bit map data, color tables for x magnified bit map data, color tables for y magnified bit map data and color tables for xy de-magnified bit map data.

Each bit map data read out by the display data reading unit 4 is converted to a color signal for display by the converter 62 referring to a color table corresponding to selected memory information delivered from the display data reading unit 4.

The converter 62 also receives commands and changes color tables to be referred to, or changes contents of color tables in accordance with the command.

Figure 15:
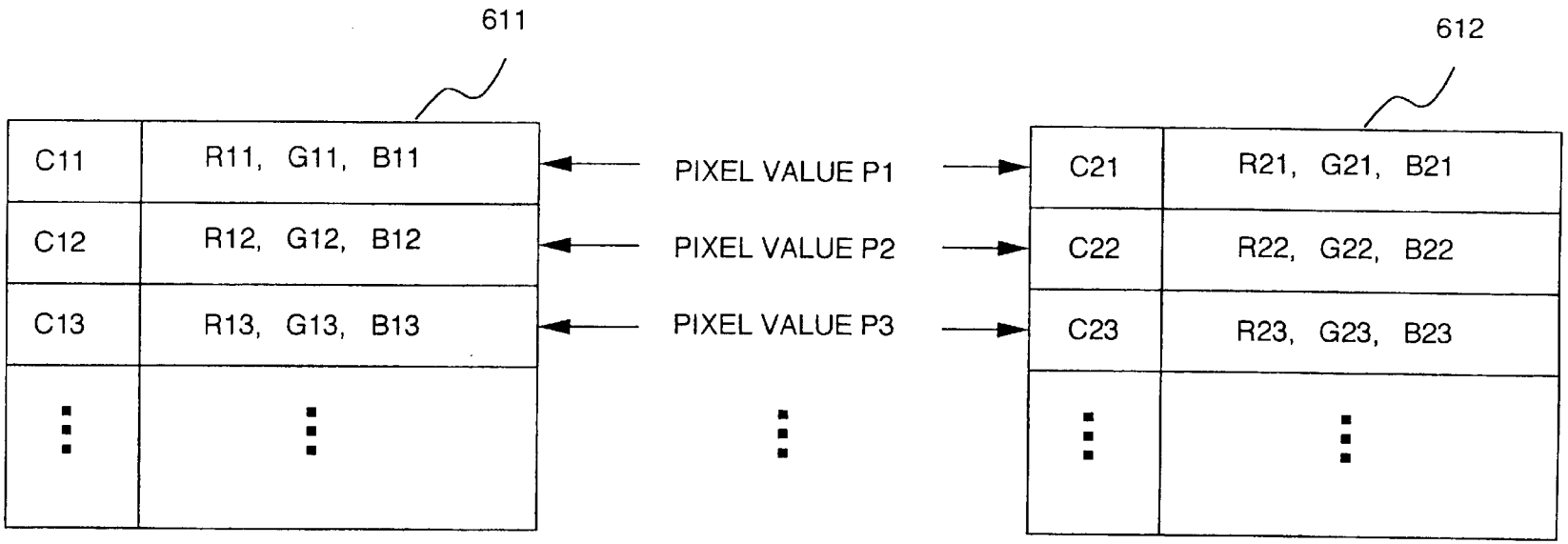
FIG. 15 shows examples of color tables stored in color table memory 61 in FIG. 5.

FIG. 15 shows an example of color tables in the color table memory 61. In this example, there are two color tables for xy magnified bit map data, a color table 611 and a color table 612. The tables store color data of R, G, B to be accessed by the pixel value of the bit map data. When the pixel value is P1, the color data C11 of R11, G11, B11 is read out when the color table 611 is selected to be referred to. When the converter 62 selects the color table 612, bit map data with a pixel value of P1 is converted to a color data C21 of R21, G21, B21 as shown in FIG. 15.

Thus, the display color can be instantly changed.

The converter 62 also can change mutual correspondence between pixel value and color data, for example, changing color data in a color table so as bit map data with the pixel value P1 is converted to color data C13 of R13, G13, B13. Or contents of a color table can be rewritten through the converter 62. In this way, a variety of combination of displayed color can easily be obtained in this invention.

Figure 6:
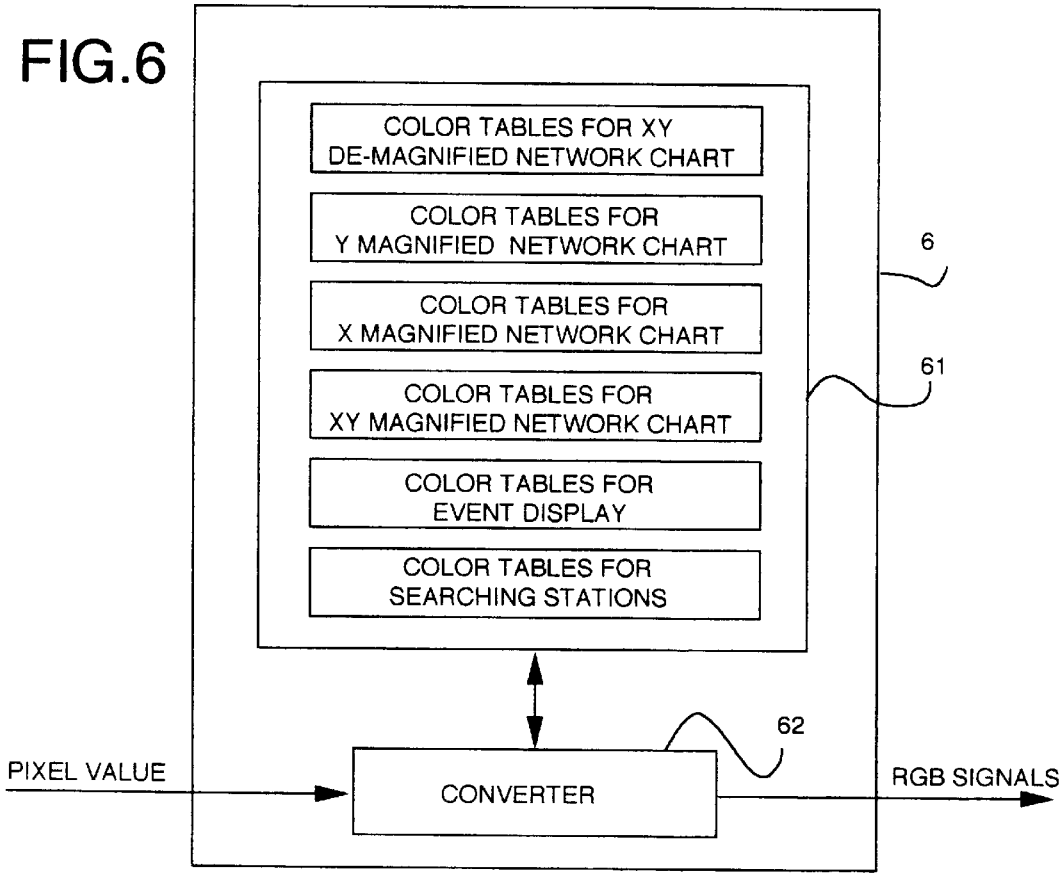
FIG. 6 shows an embodiment of display data processing unit 6 in FIG. 4.

FIG. 6 shows another embodiment of the display data processing unit 6.

Figure 16:
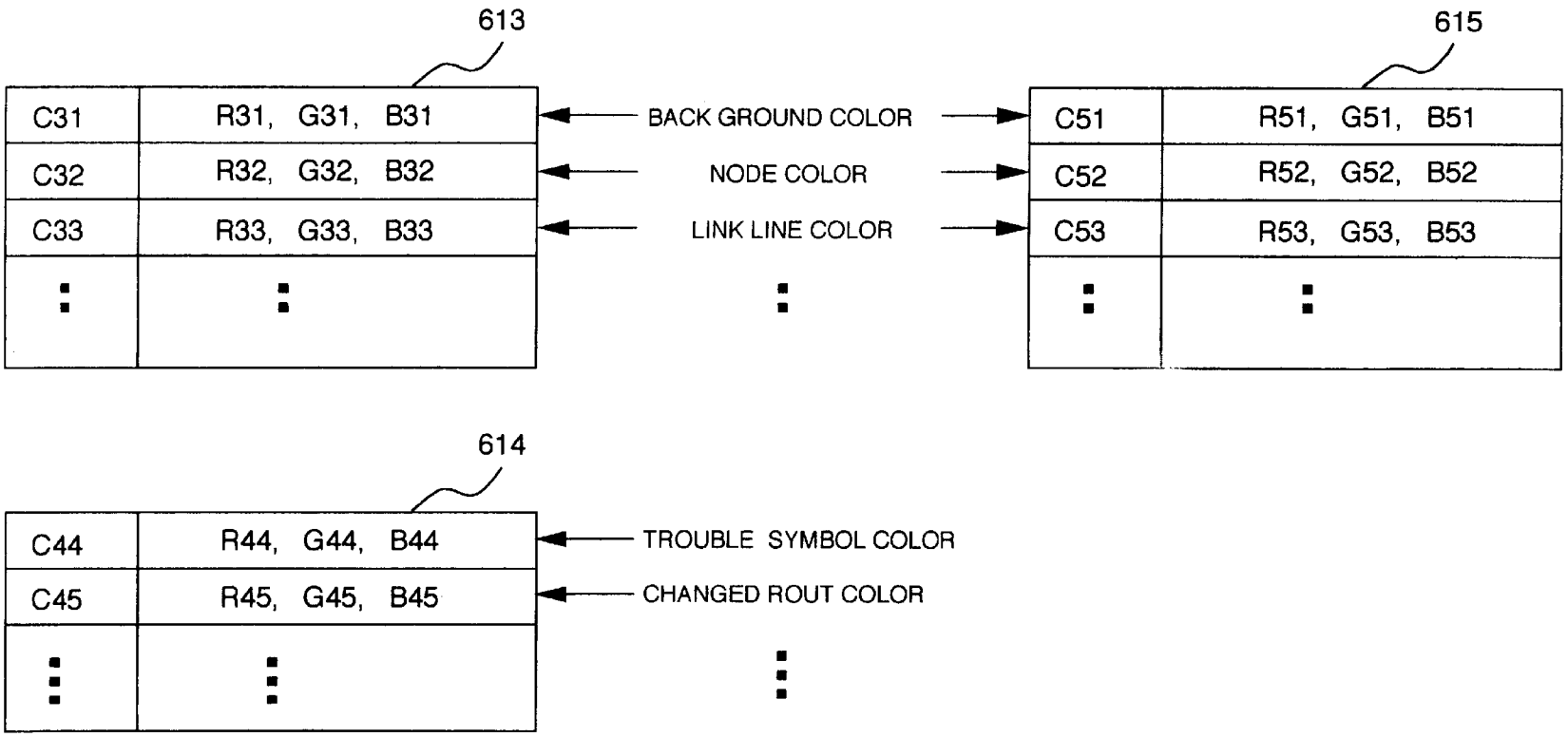
FIG. 16 shows examples of color tables stored in color table memory 61 in FIG. 6.

This embodiment of the unit 6 is adapted to be used as the unit 6 in FIG. 4, and the color table memory 61 contains color tables for the xy magnified network chart data, color tables for the x magnified network chart data, color tables for the y magnified network chart data, and color tables for the xy de-magnified network chart. Besides these color tables, color tables for searching stations in a network or color tables for event display are supplemented, for example. An example of these supplemented color tables is shown in FIG. 16.

When operation of a network is normal, a color table 613 for the xy magnified network chart is used. In this embodiment shown in FIG. 16, a pixel value of bit map data read out by the display data reading unit 4 represents one of a background color, a node color, a link line color and so on. These colors are color data C31, color data C32, color data C33 and so on in the color table 613. When a problem is reported from a node together with the address of the node to the converter 62, the converter 62 selects a color table 614 for displaying symbols around the reported address by color data C44. Similarly, changed route is displayed by color data C45 in the color table 614.

In a color table 615, color data C52 is set brighter than other color data C51, C53 and so on. When a node in a network is to be identified, the supervisor can conveniently use the color table 615.

As a variety of color tables are included in the color table memory 61 of this invention, change of operating condition of a network is promptly reported on the displayed picture by selecting an adequate color table. And, a user can instantly change the display color for easy recognition of a necessary information.

Figure 7:
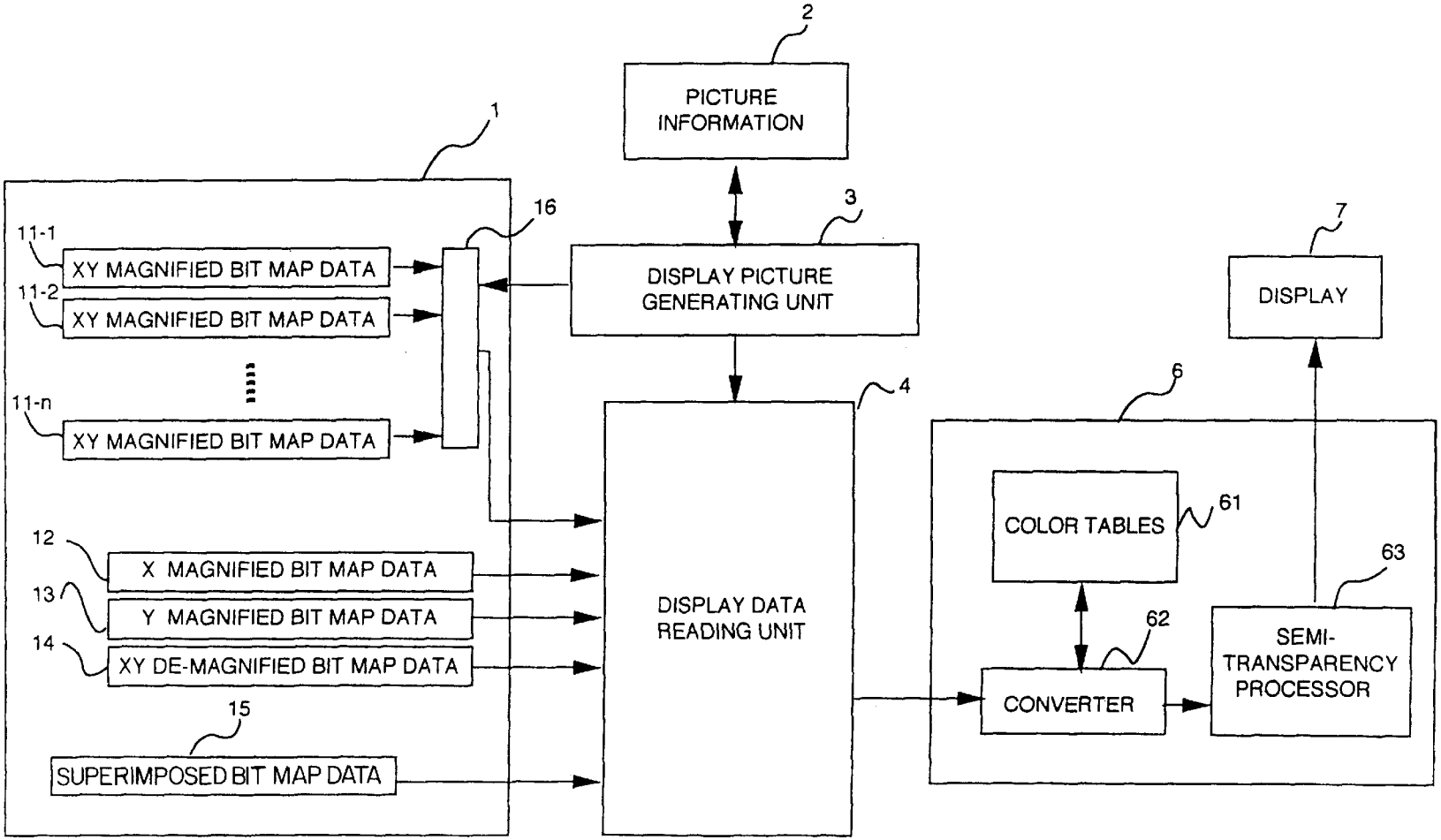
FIG. 7 is a block diagram of a sixth embodiment of the present invention.

FIG. 7 shows a block diagram of a sixth embodiment of this invention.

In the embodiment of FIG. 7, a superimpose bit map memory 15 is supplemented in the picture data storing means 1. The superimposed bit map memory 15 is also accessed according to boundary addresses calculated by the display picture generating unit 3 through the display data reading unit 4.

As will be understood from foregoing descriptions in connection with FIG. 1, only a bit map data is read out at a time from the picture data storing means 1 of FIG. 1. But from the picture data storing means 1 of FIG. 7, two bit map data are simultaneously read out in certain address range, and it must be understood that these two bit map data are transmitted on separate lines to the display data processing unit 6.

In a conventional window system as shown in FIG. 17, when bit map data 27 read out from the superimposed bit map memory 15 are superimposed on an area 272 of the Bifocal figure 22 composed of bit map data read out from other bit map memories, a part of the display object 20 displayed on the area 272 becomes indiscernible. This is a problem in a conventional window system. This problem is solved by a semi-transparent display in this embodiment.

FIG. 18 shows an example of transparency coefficients applied to areas of display. On the area 272 where the bit map data 27 and the Bifocal figure 22 overlaps, color data converted from bit map data of the superimpose bit map memory 15 is multiplied by 1−α and synthesized with color data converted from bit map data of other bit map memories and multiplied by a in a semi-transparency processor 63, composing a semi-transparent area 272 as shown in FIG. 19.

Figure 8:
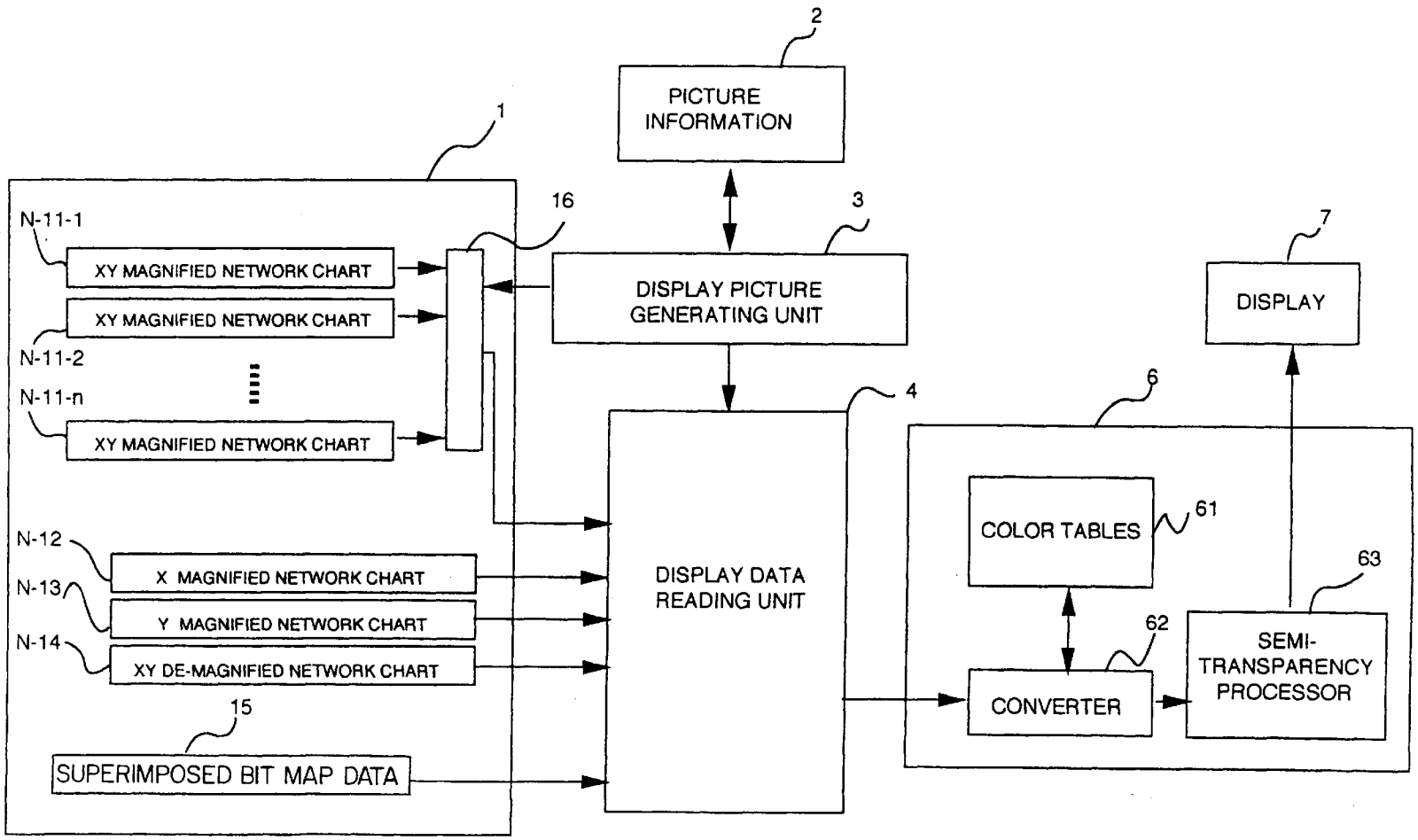
FIG. 8 is a block diagram of seventh embodiment of the present invention.

FIG. 8 shows a seventh embodiment of this invention wherein the sixth embodiment is applied to the embodiment shown in FIG. 4. In this embodiment shown in FIG. 8, if a problem is displayed in the overlapped area 272 of a network chart, the problem can be easily detected through the semi-transparent display.

The superimposed bit map memory 15 in FIG. 8 can store an xy magnified network chart of other area different from the area displayed in the Bifocal figure 22, and the xy magnified network chart of the other area can be compared to the Bifocal figure 22.

The superimposed bit map memory 15 in FIG. 8 can store a network chart illustrating a history of past events. When a trouble is reported, the network chart illustrating a history of past events can be superimposed on the Bifocal figure 22 illustrating present operating condition of the network, for convenience of estimation of a cause of the present trouble from the history of past events.

What is claimed is:

1. A picture display system wherein bit map data, corresponding to predefined sections of an original picture, which are stored in bit map memories are read out to display a Bifocal figure, said picture display system comprising:

at least two xy magnified bit map memories, each of said at least two xy magnified bit map memories storing xy magnified bit map data obtained from an original picture by magnifying said original picture and a first group of said predefined sections of said original picture by a predetermined magnification coefficient p, where p is greater than 1, in both x and y directions and supplemented with detailed information which is different from detailed information corresponding to any other one of said at least two xy magnified bit map memories;

a selector for selecting one of said at least two xy magnified bit map memories to be read;

an x magnified bit map memory for storing x magnified bit map data obtained from said original picture by magnifying a second group of said predefined sections of said original picture by said coefficient p in said x direction and de-magnifying said second group of said predefined sections of said original picture by a predetermined de-magnification coefficient 1/q, where q is greater than 1, in said y direction;

a y magnified bit map memory for storing y magnified bit map data obtained from said original picture by de-magnifying a third group of said predefined sections of said original picture by said coefficient 1/q in said x direction and magnifying said third group of said predefined sections of said original picture by said coefficient p in said y direction;

an xy de-magnified bit map memory for storing xy de-magnified bit map data obtained from said original picture by de-magnifying a fourth group of said predefined sections of said original picture by said coefficient 1/q in both said x and y directions;

a picture information storing unit for storing information to be referred to for generating said Bifocal figure from said xy magnified bit map data, said x magnified bit map data, said y magnified bit map data and said xy de-magnified bit map data;

a display picture generating unit which designates said one of said at least two xy magnified bit map memories to be selected by said selector and calculates boundary addresses of bit map data corresponding to said predefined sections of said original picture to be read for generating said Bifocal figure, said bit map data corresponding to said predefined sections being read from said one of said at least two xy magnified bit map memories, said x magnified bit map memory, said y magnified bit map memory and said xy de-magnified bit map memory, said boundary addresses being calculated based on said coefficient p, said coefficient 1/q, coordinates of a magnified area of said Bifocal figure, which corresponds to xy magnified bit map data of one of said first group of predefined sections, and information stored in said picture information storing unit;

a display data reading unit for reading out bit map data stored in said one of said at least two xy magnified bit map memories, said x magnified bit map memory, said y magnified bit map memory, and said xy de-magnified bit map memory according to said boundary addresses calculated by said display picture generating unit;

a display data processing unit for generating color signals for each bit map data read out by said display data reading unit; and a display unit for displaying said Bifocal figure with said color signals generated at said display data processing unit.

2. A picture display system wherein bit map data, corresponding to predefined sections of an original picture, which are stored in bit map memories are read out to display a Bifocal figure, said picture display system comprising:

at least two sets of bit map memories, each of said at least two sets of bit map memories containing at least two xy magnified bit map memories which each store xy magnified bit map data obtained from an original picture by magnifying said original picture and a first group of said predefined sections of said original picture by a predetermined magnification coefficient p, where p is greater than 1, in both x and y directions and supplemented with detailed information which is different from detailed information corresponding to any other one of said at least two xy magnified bit map memories, a selector for selecting one of said at least two xy magnified bit map memories to be read, an x magnified bit map memory for storing x magnified bit map data obtained from said original picture by magnifying a second group of said predefined sections of said original picture by said coefficient p in said x direction and de-magnifying said second group of said predefined sections of said original picture by a predetermined de-magnification coefficient 1/q, where q is greater than 1, in said y direction, a y magnified bit map memory for storing y magnified bit map data obtained from said original picture by de-magnifying a third group of said predefined sections of said original picture by said coefficient 1/q in said x direction and magnifying said third group of said predefined sections of said original picture by said coefficient p in said y direction, and an xy de-magnified bit map memory for storing xy de-magnified bit map data obtained from said original picture by de-magnifying a fourth group of said predefined sections of said original picture by said coefficient 1/q in both said x and y directions, said magnification coefficient, p, and said de-magnification coefficient, 1/q, each having values which are different for each of said at least two sets of bit map memories;

a picture information storing unit for storing information to be referred to for generating said Bifocal figure from said xy magnified bit map data, said x magnified bit map data, said y magnified bit map data and said xy de-magnified bit map data corresponding to said at least two sets of bit map memories;

a display picture generating unit which selects one of said at least two sets of bit map memories to be read, designates said one of said at least two xy magnified bit map memories to be selected by said selector in said one of said at least two sets of bit map memories, and calculates boundary addresses of bit map data corresponding to said predefined sections of said original picture to be read for generating said Bifocal figure, said bit map data corresponding to said predefined sections being read from said one of said at least two xy magnified bit map memories, said x magnified bit map memory, said y magnified bit map memory and said xy de-magnified bit map memory of said one of said at least two sets of bit map memories, said boundary addresses being calculated based on said coefficient p and said coefficient 1/q of said one of said at least two sets of bit map memories, coordinates of a magnified area of said Bifocal figure corresponding to xy magnified bit map data of one of said first group of predefined sections, and information stored in said picture information storing unit;

a display data reading unit for reading out bit map data stored in said one of said at least two xy magnified bit map memories, said x magnified bit map memory, said y magnified bit map memory, and said xy de-magnified bit map memory in said one of said at least two sets of bit map memories according to said boundary addresses calculated by said display picture generating unit;

a display data processing unit for generating color signals for each bit map data read out by said display data reading unit; and a display unit for displaying said Bifocal figure with said color signals generated at said display data processing unit.

3. A picture display system wherein network chart data, corresponding to predefined sections of an original network chart, which are stored in network chart memories are read out to display a Bifocal figure, said picture display system comprising:

at least two xy magnified network chart memories, each of said at least two xy magnified network chart memories storing xy magnified network chart data obtained from an original network chart by magnifying said original network chart and a first group of said predefined sections of said original network chart by a predetermined magnification coefficient p, where p is greater than 1, in both x and y directions and supplemented with detailed information which is different from detailed information corresponding to any other one of said at least two xy magnified network chart memories;

a selector for selecting one of said at least two xy magnified network chart memories to be read;

an x magnified network chart memory for storing x magnified network chart data obtained from said original network chart by magnifying a second group of said predefined sections of said original network chart by said coefficient p in said x direction and de-magnifying said second group of said predefined sections of said original network chart by a predetermined de-magnification coefficient 1/q, where q is greater than 1, in said y direction;

a y magnified network chart memory for storing y magnified network chart data obtained from said original network chart by de-magnifying a third group of said predefined sections of said original network chart by said coefficient 1/q in said x direction and magnifying said third group of said predefined sections of said original network chart by said coefficient p in said y direction;

an xy de-magnified network chart memory for storing xy de-magnified network chart data obtained from said original network chart by de-magnifying a fourth group of said predefined sections of said original network chart by said coefficient 1/q in both said x and y directions;

a picture information storing unit for storing information to be referred to for generating said Bifocal figure from said xy magnified network chart data, said x magnified network chart data, said y magnified network chart data and said xy de-magnified network chart data;

a display picture generating unit which designates said one of said at least two xy magnified network chart memories to be selected by said selector and calculates boundary addresses of network chart data corresponding to said predefined sections of said original network chart to be read for generating said Bifocal figure, said network chart data corresponding to said predefined sections being read from said one of said at least two xy magnified network chart memories, said x magnified network chart memory, said y magnified network chart memory and said xy de-magnified network chart memory, said boundary addresses being calculated based on said coefficient p, said coefficient 1/q, coordinates of a magnified area of said Bifocal figure, which corresponds to xy magnified network chart data of one of said first group of predefined sections, and information stored in said picture information storing unit;

a display data reading unit for reading out network chart data stored in said one of said at least two xy magnified network chart memories, said x magnified network chart memory, said y magnified network chart memory, and said xy de-magnified network chart memory according to said boundary addresses calculated by said display picture generating unit;

a display data processing unit for generating color signals for each network chart data read out by said display data reading unit; and a display unit for displaying said Bifocal figure with said color signals generated at said display data processing unit.

4. A picture display system wherein network chart data corresponding to predefined sections of an original network chart, which are stored in network chart memories are read out to display a Bifocal figure, said picture display system comprising:

at least two sets of network chart memories, each of said at least two sets of network chart memories containing at least two xy magnified network chart memories which each store xy magnified network chart data obtained from an original network chart by magnifying said original network chart and a first group of said predefined sections of said original network chart by a predetermined magnification coefficient p, where p is greater than 1, in both x and y directions and supplemented with detailed information which is different from detailed information corresponding to any other one of said at least two xy magnified network chart memories, a selector for selecting one of said at least two xy magnified network chart memories to be read, an x magnified network chart memory for storing x magnified network chart data obtained from said original network chart by magnifying a second group of said predefined sections of said original network chart by said coefficient p in said x direction and de-magnifying said second group of said predefined sections of said original network chart by a predetermined de-magnification coefficient 1/q, where q is greater than 1, in said y direction, a y magnified network chart memory for storing y magnified network chart data obtained from said original network chart by de-magnifying a third group of said predefined sections of said original network chart by said coefficient 1/q in said x direction and magnifying said third group of said predefined sections of said original network chart by said coefficient p in said y direction, and an xy de-magnified network chart memory for storing xy de-magnified network chart data obtained from said original network chart by de-magnifying a fourth group of said predefined sections of said original network chart by said coefficient 1/q in both said x and y directions, said magnification coefficient, p, and said demagnification coefficient, 1/q, having different values for each of said at least two sets of network chart memories;

a picture information storing unit for storing information to be referred to for generating said Bifocal figure from said xy magnified network chart data, said x magnified network chart data, said y magnified network chart data and said xy de-magnified network chart data;

a display picture generating unit which selects one of said at least two sets of network chart memories to be read, designates said one of said at least two xy magnified network chart memories to be selected by said selector in said one of said at least two sets of network chart memories, and calculates boundary addresses of network chart data corresponding to predefined sections of said original network chart to be read for generating said Bifocal figure, said network chart data corresponding to predetermined sections being read from said one of said at least two xy magnified network chart memories, said x magnified network chart memory, said y magnified network chart memory and said xy de-magnified network chart memory of said one of said at least two sets of network chart memories, said boundary addresses being calculated based on said coefficient p and said coefficient 1/q of said one of said at least two sets of network chart memories, coordinates of a magnified area of said Bifocal figure, which corresponds to xy magnified network chart data of one of said first group of predefined sections, and information stored in said picture information storing unit;

a display data reading unit for reading out network chart data stored in said one of said at least two xy magnified network chart memories, said x magnified network chart memory, said y magnified network chart memory, and said xy de-magnified network chart memory in said one of said at least two sets of network chart memories according to said boundary addresses calculated by said display picture generating unit;

a displaying data processing unit for generating color signals for each network chart data read out by said display data reading unit; and a display unit for displaying said Bifocal figure with said color signals generated at said display data processing unit.

5. A picture display system of claim 3 or claim 4, wherein said network chart data stored in said at least two xy magnified network chart memories, said x magnified network chart memory, said y magnified network chart memory and said xy de-magnified network chart memory are prepared such that node symbols of a same type have a same size and a same form and link symbols of a same type have a same thickness when displayed on said Bifocal figure.

6. A picture display system of claim 3 or claim 4, wherein said x magnified network chart data, said y magnified network chart data and said xy de-magnified network chart data are composed of simplified information of said original network chart, and wherein said xy magnified network chart data include detailed information corresponding to said original network chart.

7. A picture display system of claim 1 or claim 2, wherein said display data processing unit comprises:

a color table memory for storing color tables corresponding to said xy magnified bit map data, said x magnified bit map data, said y magnified bit map data and said xy de-magnified bit map data and containing color data having correspondence with pixel values of bit map data read out by said display data reading unit; and a converter for selecting a color table to be referred to from color tables stored in said color table memory and generating color signals for bit map data read out by said display data reading unit based on contents of said color table.

8. A picture display system of claim 7, characterized in that said converter changes said correspondence between pixel values and color data.

9. A picture display system of claim 7, characterized in that said converter changes contents of said color tables.

10. A picture display system of claim 3 or claim 4, wherein said display data processing unit comprises:

a color table memory for storing a first set of color tables corresponding to said xy magnified network chart data, said x magnified network chart data, said y magnified network chart data and said xy de-magnified network chart data, and a second set of color tables for displaying events related to a monitored network corresponding to said original network chart, said color tables in said color table memory containing color data having a correspondence with pixel values of network chart data read out by said display data reading unit; and a converter for selecting a color table to be referred to from color tables stored in said color table memory and generating color signals for network chart data read out by said display data reading unit based on contents of said color table.

11. A picture display system of claim 10, characterized in that said converter changes said correspondence between pixel values and color data.

12. A picture display system of claim 10, characterized in that said converter changes contents of said color tables.

13. A picture display system of claim 1 or claim 2, further comprising a superimposed bit map memory for storing bit map data to be superimposed on said Bifocal figure;

said picture information storing unit storing information on bit map data stored in said superimposed bit map memory;

said display picture generating unit calculating boundary addresses of a superimposed picture of said superimposed bit map memory when said superimposed picture is selected to be synthesized with said Bifocal figure;

said display data reading unit reading out bit map data from said superimposed bit map memory in accordance with said boundary addresses of said superimposed picture at the same time that said bit map data for generating said Bifocal figure is being read out;

wherein said display data processing unit comprises a semi-transparency processor for synthesizing a first group of color signals, which are each generated by said converter from bit map data for generating said Bifocal figure and multiplied by a predetermined semi-transparency coefficient $\alpha$, which is greater than zero but less than one, with a second group of color signals, which are each generated by said converter from bit map data for generating said superimposed picture and multiplied by $1-\alpha$ in an area where said Bifocal figure is superimposed by said superimposed picture.

14. A picture display system of claim 3 or claim 4, further comprising a superimposed bit map memory for storing bit map data to be superimposed on said Bifocal figure;

said picture information storing unit storing information on bit map data stored in said superimposed bit map memory;

said display picture generating unit calculating boundary addresses of a superimposed picture of said superimposed bit map memory when said superimposed picture is selected to be synthesized with said Bifocal figure;

said display data reading unit reading out bit map data from said superimposed bit map memory in accordance with said boundary addresses of said superimposed picture at the same time with network chart data for generating said Bifocal figure;

wherein said display data processing unit comprises a semi-transparency processor for synthesizing a first group of color signals, which are each generated by said converter from network chart data for generating said Bifocal figure and multiplied by a predetermined semi-transparency coefficient $\alpha$, which is greater than zero but less than one, with a second group of color signals which are each generated by said converter from bit map data for generating said superimposed picture and multiplied by $1-\alpha$ in an area where said Bifocal figure is superimposed by said superimposed picture.

* * * * *